US009500440B2

(12) United States Patent
Gordon et al.

(10) Patent No.: US 9,500,440 B2
(45) Date of Patent: Nov. 22, 2016

(54) INSIDE WAISTBAND HOLSTER FOR A CONCEALED WEAPON

(71) Applicant: Turning Point Distribution, LLC, Sorrento, FL (US)

(72) Inventors: Cecil Wayne Gordon, Hastings, FL (US); David A. Foster, Sorrento, FL (US)

(73) Assignee: Turning Point Distribution, LLC, Sorrento, FL (US)

( * ) Notice: Subject to any disclaimer, the term of this patent is extended or adjusted under 35 U.S.C. 154(b) by 21 days.

(21) Appl. No.: 14/696,252

(22) Filed: Apr. 24, 2015

(65) Prior Publication Data

US 2016/0061564 A1 Mar. 3, 2016

Related U.S. Application Data

(60) Provisional application No. 61/944,912, filed on Feb. 26, 2014.

(51) Int. Cl.
*F41C 33/02* (2006.01)
*F41C 33/04* (2006.01)

(52) U.S. Cl.
CPC ..... *F41C 33/041* (2013.01); *F41C 33/0218* (2013.01); *F41C 33/048* (2013.01)

(58) Field of Classification Search
CPC .... F41C 33/04; F41C 33/041; F41C 33/043; F41C 33/045; F41C 33/046; F41C 33/048; F41C 33/02; F41C 33/0209; F41C 33/0218; F41C 33/0227; F41C 33/0254; F41C 33/0263; F41C 33/0272; F41C 33/0281; F41C 33/029
USPC ..... 224/192–193, 198, 238, 243–244, 911, 224/587
See application file for complete search history.

(56) References Cited

U.S. PATENT DOCUMENTS

| | | | | |
|---|---|---|---|---|
| 3,379,349 | A * | 4/1968 | Hier | F41C 33/0209 224/666 |
| 4,165,826 | A * | 8/1979 | Chica | F41C 33/0209 224/191 |
| 4,858,800 | A * | 8/1989 | Holtzclaw, Jr. | F41C 33/0227 224/193 |
| 6,561,402 | B2 * | 5/2003 | Holland | A45F 5/00 224/192 |
| 2003/0094470 | A1 * | 5/2003 | Cragg | A45F 5/021 224/236 |
| 2006/0219743 | A1 * | 10/2006 | Gallagher | A45F 5/02 224/192 |
| 2013/0015225 | A1 * | 1/2013 | Hogue | F41C 33/0218 224/587 |
| 2013/0306693 | A1 * | 11/2013 | Prestwich | A45F 5/00 224/269 |
| 2015/0237998 | A1 * | 8/2015 | Stevens, IV | A45F 5/021 224/660 |

* cited by examiner

*Primary Examiner* — Justin Larson
*Assistant Examiner* — Scott McNurlen
(74) *Attorney, Agent, or Firm* — Weide & Miller, Ltd.

(57) ABSTRACT

An inside waistband holster includes a front panel comprising a waistband connector that holds a top side of the front panel at a waistline of a user's pants. The holster also includes a back panel attached to the front panel, such as along a bottom side of the back panel and the front panel and along lower sides of the back panel and the front panel. The front panel and the back panel define a pouch in which a firearm may in stored, and a top portion of the front panel is unattached to the back panel. The back panel includes a flap configured to extend over the front panel and to releasably connect to the waistband connector in a stored condition. The flap is also configured to be pulled upward such that the top portion of the front panel peels away from the back panel in an exposed position.

3 Claims, 5 Drawing Sheets

INSIDE WAISTBAND HOLSTER FOR A CONCEALED WEAPON

CROSS REFERENCE TO RELATED APPLICATION

This application claims priority to U.S. Provisional Application No. 61/944,912 which was filed on Feb. 26, 2014, the contents of which are hereby incorporated by reference.

BACKGROUND

The disclosed embodiments relate to wearable pouches, bags, packs, or holsters. Some embodiments may relate to holsters for carrying firearms. Other embodiments may relate to holsters that can be worn inside the waistband to carry a concealed weapon.

Individuals with a concealed weapons license (CWL) must generally follow a number of guidelines in order to maintain their carrying permit. One of the guidelines describes the manner in which the weapon, typically a handgun, is carried on the person. The handgun must be completely covered at all times and cannot "paint" an impressed image of the handgun through any of the person's clothing.

Many holsters are worn on the outside of the belt. To be within the guidelines of a CWL, a person must wear a very large and loose shirt or jacket to cover the handgun. Another option is to use an IWB (inside waistband) style holster. This style of holster typically tucks the handgun inside the pants or pocket. However, in most instances the firearm's handle still protrudes from the top of the holster and needs to be covered with additional clothing to avoid exposure.

In order to be within concealed weapons guidelines the handgun cannot be visible in any way. However, as described above, typical belt-worn holsters have a part of the handgun or the handgun in its entirety exposed. This results in the need for additional and typically loose clothing to be worn by the user in order to be within the licensed guidelines.

SUMMARY

The disclosed embodiments have been developed in light of the above-described problems. The disclosed embodiments described herein could be termed as an "internal pocket" that completely conceals a firearm in its entirety. The embodiments also prevent the "painting" of the firearm's shape through the user's clothing while simultaneously providing easy access to the firearm for the user. In addition, the inside of the flap or other areas of the holster may include prefabricated slots for the user's carry permit, identification card(s), and/or other paperwork.

The disclosed embodiments differ from what currently exists. The design of the concealed weapons handgun holster as described in the embodiments below completely conceals a firearm without the need for additional bulky clothing to cover the firearm, while also providing immediate access and storage. This design conceals the firearm in its entirety without the handle or any parts of the firearm being exposed. This prevents any unintentional exposure to others while also preventing theft or loss.

According to some embodiments, an inside waistband holster includes a front panel comprising a waistband connector that holds a top side of the front panel at a waistline of a user's pants. The holster also includes a back panel attached to the front panel along a bottom side of the back panel and the front panel and along lower sides of the back panel and the front panel. The front panel and the back panel define a pouch in which a firearm may in stored, and a top portion of the front panel is unattached to the back panel. The back panel includes a flap configured to extend over the front panel and to releasably connect to the waistband connector in a stored condition. The flap is also configured to be pulled upward such that the top portion of the front panel peels away from the back panel in an exposed position, raising and exposing any firearm located in the holster.

Further objects, features, and advantages of the present invention over the prior art will become apparent from the detailed description of the drawings which follows, when considered with the attached figures.

DETAILED DESCRIPTION OF EMBODIMENTS

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Figure 1:
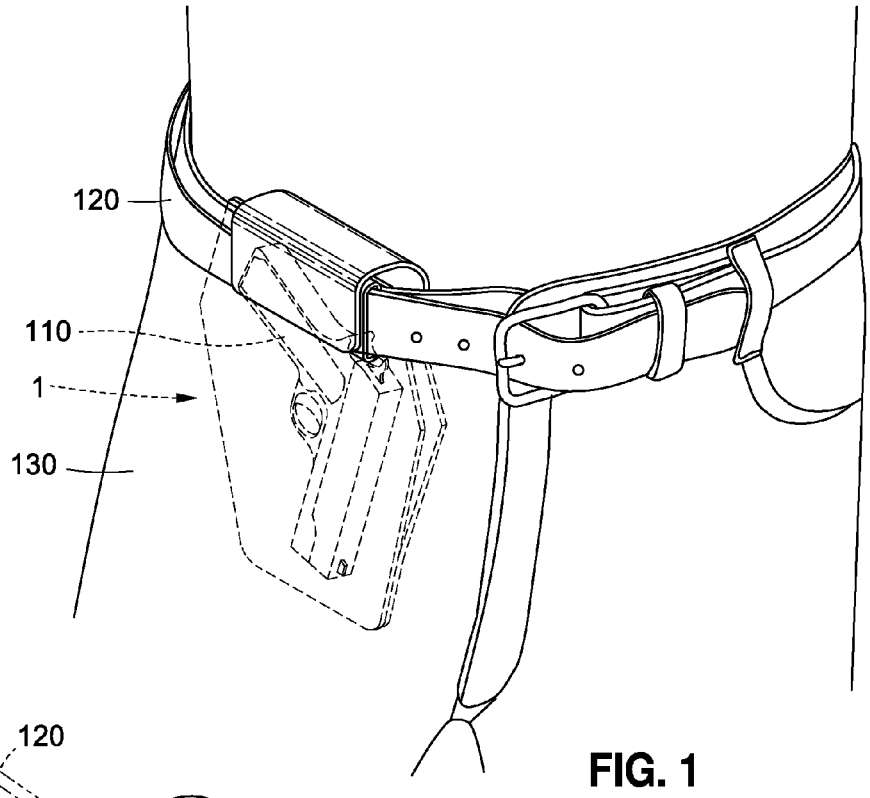
FIG. 1 illustrates an inside waistband holster for a concealed weapon as worn by a user according to one exemplary embodiment.

FIG. 1 illustrates an inside waistband holster for a concealed weapon as worn by a user according to one exemplary embodiment. As shown in FIG. 1, a holster 1 is configured to be worn inside the waistband of a user. In this embodiment, the holster 1 attaches to a user's belt 120 and is worn on the inside of the user's pants 130. The holster 1 is comprised of pliable material, such as leather, faux leather, cloth, nylon, or other fabrics or the like.

Figure 2A:
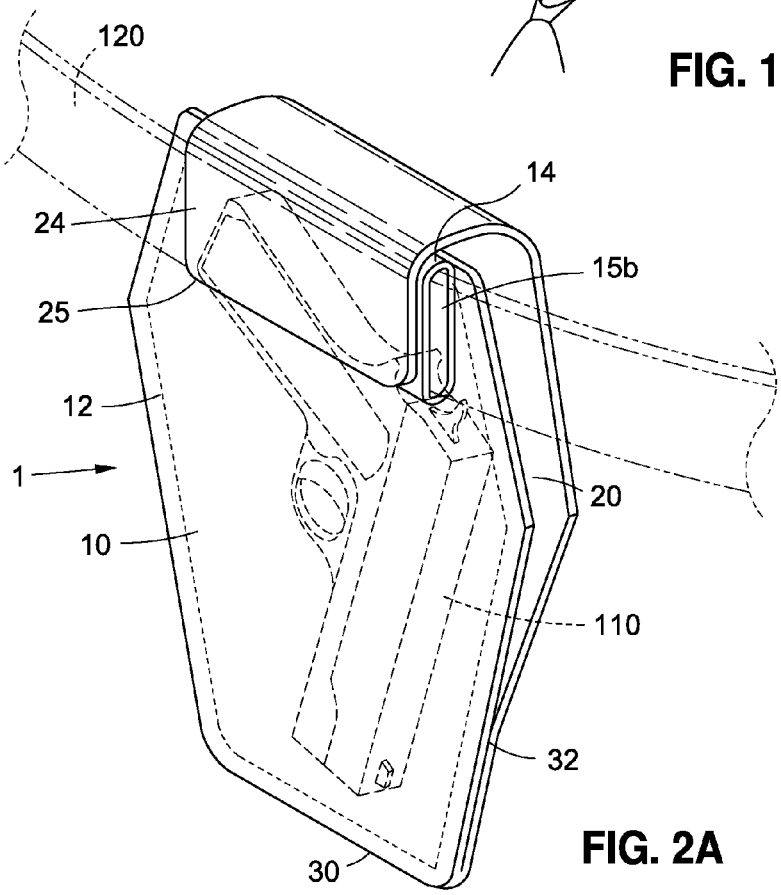
FIG. 2A illustrates an inside waistband holster for a concealed weapon.
Figure 2B:
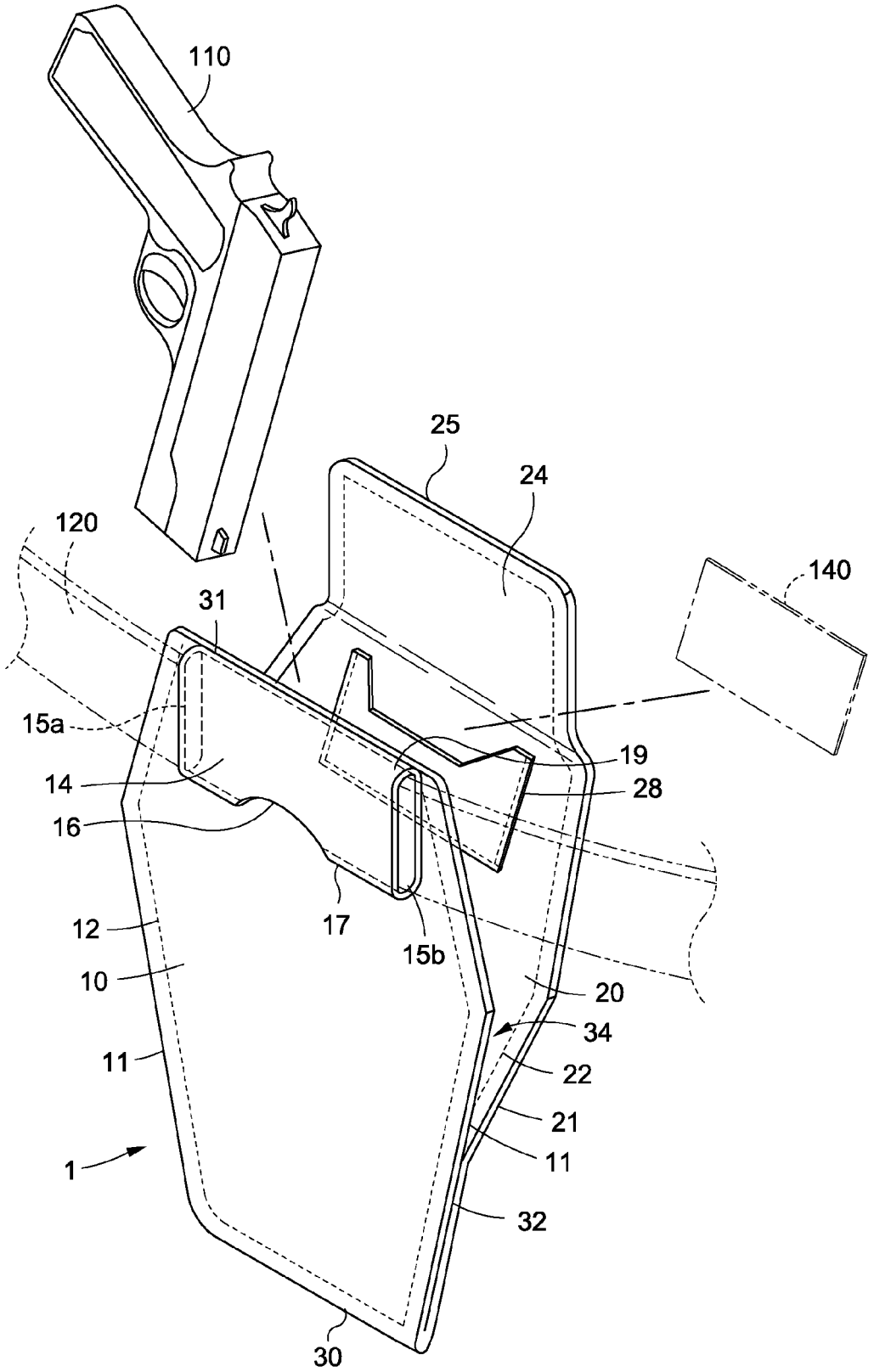
FIG. 2B is a view of the holster of FIG. 2A with the flap open, according to one exemplary embodiment.

FIG. 2A shows the inside waistband holster for a concealed weapon in a closed position, and FIG. 2B is a view of the holster of FIG. 2A with the flap open, according to one exemplary embodiment. The holster 1 includes a front panel 10 and a back panel 20. The front panel 10 and the back panel 20 are preferably joined together along the bottom side 30 of the holster 1. The front panel 10 may be joined to the back panel 20 along the bottom side 30 by any known manner such as by stitching, adhesives, fasteners, or the like. In one embodiment, the front panel 10 and the back panel 20 are formed or cut from a single piece of material and are folded together at the bottom side 30 of the holster. The front panel 10 and the back panel 20 may include stitching 12, 22 along the borders of the panels 10, 20 for decorative effect, and to prevent fraying of the material. The stitching 12, 22 may also serve to hold layers of fabric together which may collectively form the front panel 10 and the back panel 20 in some embodiments.

The front panel 10 preferably includes a mean for mounting the holster 1 to a wearers pants, such as an associated belt. In one embodiment, the means for mounting comprises a belt loop 14 that is configured to receive a belt 120 therethrough. The belt loop 14 is connected to the front panel 10 at the top 31 of the front panel 10. Specifically, a top portion 19 of the belt loop 14 is attached to the top 31 of the front panel such that the belt loop 14 may be on the outside of the pants 130 while the remainder of the font panel 10 is inside the pants.

The belt loop 14 may be attached to the front panel in any suitable manner including stitching, adhesives, fasteners, or the like. The belt loop 14 may also be formed integrally with the front panel and is folded over at the top 31 of the holster. The belt loop forms a first hole 15*a* and a second hole 15*b* through which the belt 120 may pass. To aid the user in threading the belt 120 through the belt loop 14, a cutout 16 may be provided in a lower side 17 of the belt loop. The cutout 16 may also accommodate a belt loop associated with the pants, whereby the user may thread their belt through the first portion of the belt loop 14, then the pants belt loop, then the second portion of the belt loop, thus securing the belt to their pants and securing the holster 1 to the belt 120.

The back panel 20 includes a top flap 24. The top flap 24 is configured to releasably connect to the front panel 10, such as the belt loop 14. In one embodiment, the top flap 24 is configured to extend around the top 31 of the front panel 10 so that the tip 25 of the flap 24 releasably attaches to the belt loop 14, such as a front thereof or at the bottom side 17 of the belt loop 14. The flap 24 allow the user to selectively gain access to the firearm 110 in the holster 1, as will be described in more detail below.

The front panel 10 and the back panel 20 cooperate to form a pouch 34. In one embodiment, the pouch 34 is defined by the front panel 10, the back panel 20, the bottom side 30 of the holster 1, and a connection 32 between the sides 11, 21 of the front panel 10 and the back panel 20. The connection 32 may be stitching, adhesive, fasteners, connecting fabric or other material or the like that extends partially up the sides 11, 21 of the front and back panels 10, 20. The height of connection 32 may extend further or less than that shown in the figures so long as the holster 1 may be configured to operate as described in more detail below.

The pouch 34 is configured to hold the firearm 110 within the holster 1. When the holster 1 is closed, as described below and illustrated in FIG. 1, the firearm 110 is located inside the pouch 34—.e.g is not visible from the outside of the holster 1. Thus, the pouch 34, and thus the front and back panels, is sized to accommodate a firearm. The size of the pouch 34, and thus the configuration of the front and back panels, may vary depending upon the particular firearm 110 which is to be housed in the holster 1 (for example, the size and shape of the front and back panels may vary to change the size and shape of the pouch, such as to accommodate firearms of different sizes and/or shapes).

The pouch 34 may further be configured to hold other items next to the firearm 110, or in place of the firearm 110 when the firearm 110 is not being carried. For example, the pouch 34 may hold the user's cell phone, ammunition for the fire arm, keys, wallet, and the like.

In this embodiment, the back panel further includes a slot 28 for holding a card 140, such as a concealed weapons permit, identification, credit card, or the like. In FIG. 2B, the slot 28 is associated with or defined at the inside of the back panel 20. However, the slot 28 may be placed at any suitable location on the holster 1. For example, there may be a slot 28 on the front of the belt loop 14, on the inside of the top flap 24, or on the rear surface of the back panel 20. More than one slot 28 may be implemented on the holster 1.

Figure 3A:
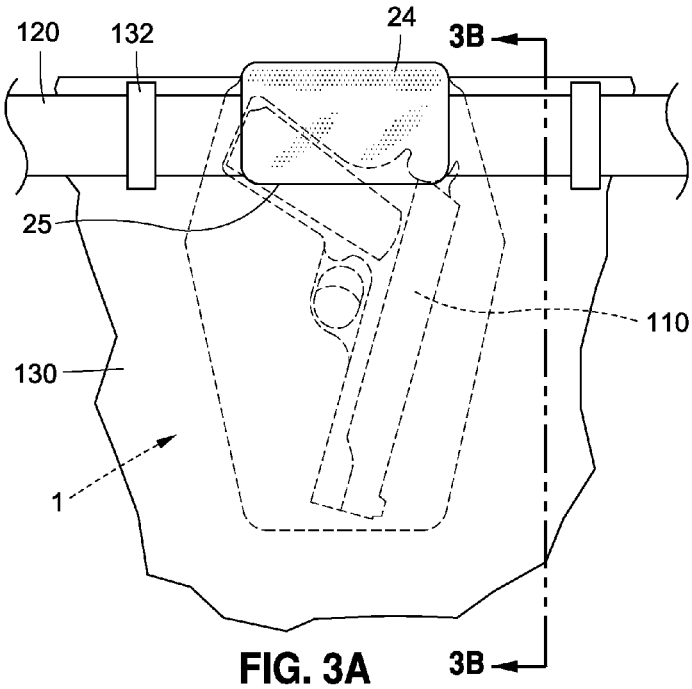
FIG. 3A is a front view of an inside waistband holster for a concealed weapon in a first position, according to one exemplary embodiment.
Figure 3B:
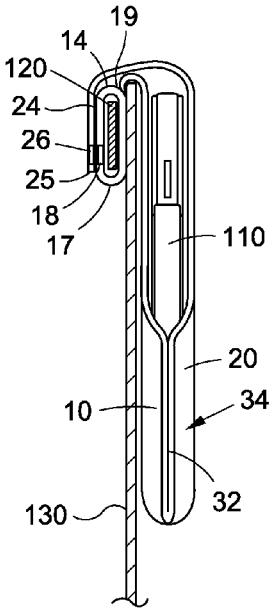
FIG. 3B is a side view of the holster shown in FIG. 3A.

The operation of the holster 1 will now be described with reference to FIGS. 3A-5C. FIGS. 3A and 3B show the holster 1 with the firearm 110 in a stored position. Specifically, the holster 1 is threaded onto the belt 120 by way of the belt loop 14. The top of the waistband of the pants fits between the belt loop 14 and the front panel 10. The top flap 24 is in the closed position such that the top 25 of the flap 24 is attached to the bottom side 17 of the belt loop 14. In this position the firearm 110 is completely enclosed, hidden within the holster 1 and positioned inside of the wearer's pants, below the waistline.

In this embodiment, the top 35 of the flap 24 includes an embedded magnet or magnetically attracted material 26. The bottom side 17 of the belt loop 14 similarly includes a corresponding embedded magnet or magnetically attracted material 18. In this manner, when the holster 1 is in the closed position, the top 25 of the flap 24 and the bottom 17 of the belt loop 14 are held together by the magnetic force between the magnets 18, 26. Other connectors or means for connecting the flap 24 and the belt loop 14 may also be used including hook and loop fasteners (known as Velcro®), a buckle, snaps, clips, buttons, or any other suitable releasable connector.

Figure 4A:
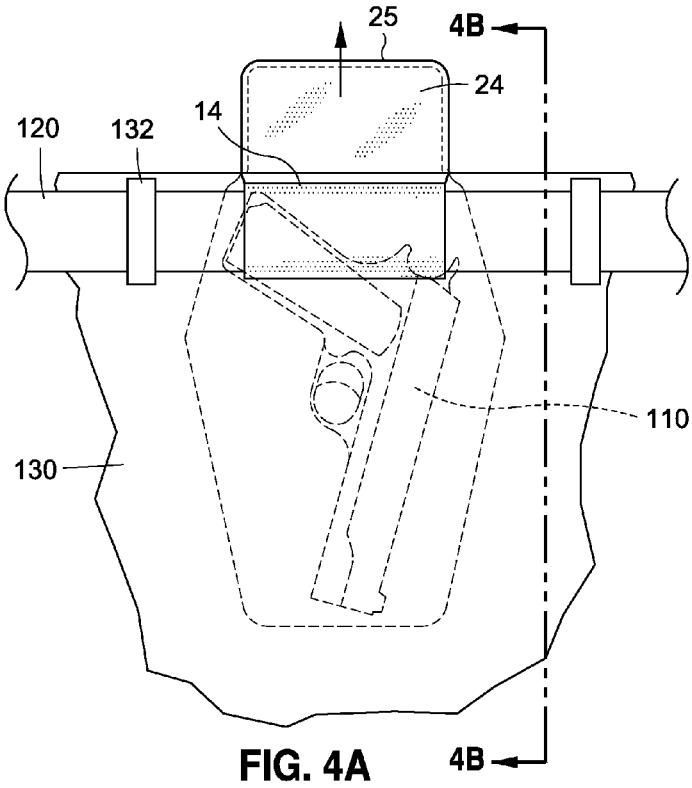
FIG. 4A is a front view of an inside waistband holster for a concealed weapon in a second position, according to one exemplary embodiment.
Figure 4B:
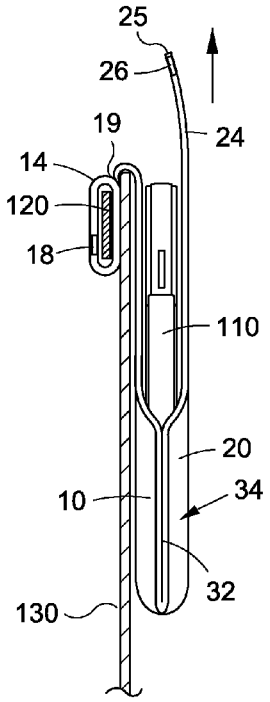
FIG. 4B is a side view of the holster shown in FIG. 4A.
Figure 5A:
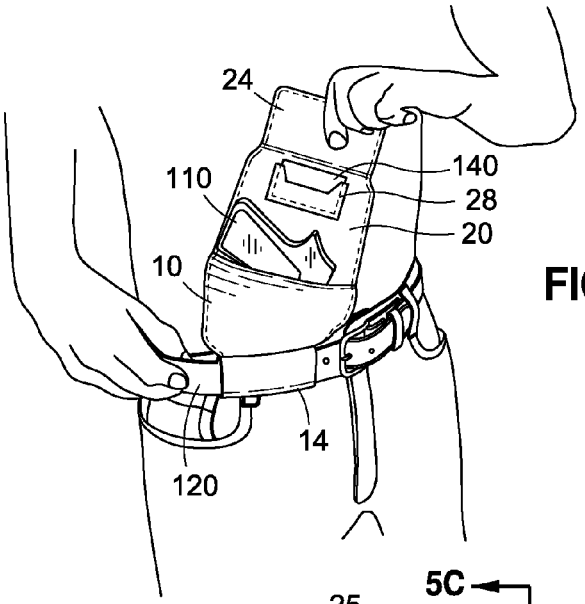
FIG. 5A is a perspective view of an inside waistband holster for a concealed weapon in a third position as worn by a user, according to one exemplary embodiment.
Figure 5B:
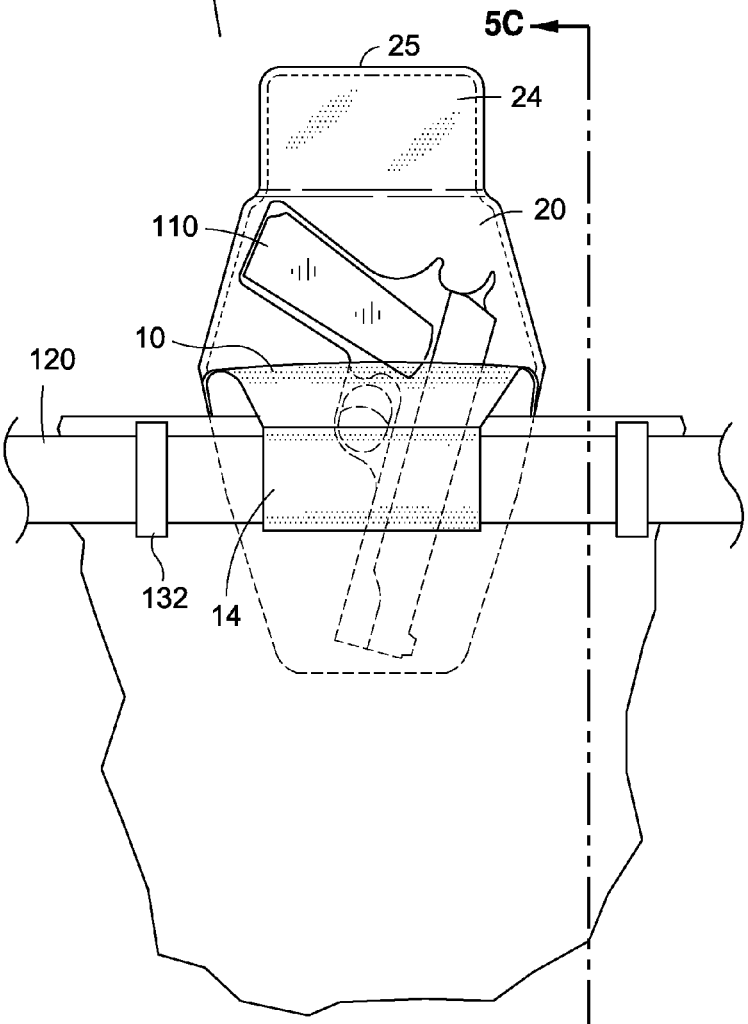
FIG. 5B is a front view of the holster shown in FIG. 5A.
Figure 5C:
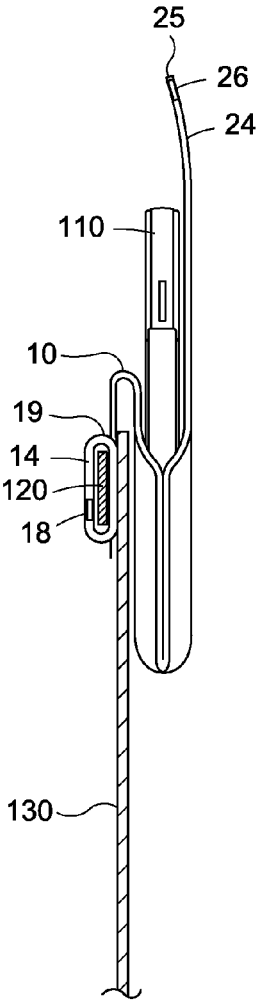
FIG. 5C is a side view of the holster shown in FIG. 5A.

To access the firearm 110 within the holster 1, the flap 24 is first moved to the position shown in FIGS. 4A and 4B. That is, the user disconnects the top 25 of the flap 24 from the bottom 17 of the belt loop 14 and pulls the flap 24 upwards. It is noted that even when the holster 1 is in the position shown in FIGS. 4A and 4B with the flap 24 pulled up, the firearm 110 remains concealed below the waistline of the user's pants 130.

To expose and remove the firearm 110, the user continues to pull upwardly on the flap 24. This motion causes the front panel 20 to roll upwardly, raising the bottom 30 of the pouch 34 of the holster 1. The user may thus in this manner raise the holster 1 into the position shown in FIGS. 5A-5C. As can be seen, the front panel 10 remains connected to the belt loop 14 and is rolled open as the holster 1 is raised. Stated differently, the front panel 10 peels away from the back panel 20 as the holster 1 is raised due to the connection between the front panel 10 and the belt loop 14 that is threaded onto the user's belt 120.

With the front panel 10 in this position, the firearm 110 is exposed, and the user can easily gain access to the firearm 110. Furthermore, because the front panel 10 is attached to the belt loop 14, the firearm 110 remains securely in the pouch 34 and does not fall out. That is, the connection 32 between the front and the back panels 10, 20 forming the pouch 34 limits the distance that the holster 1 can be raised by limiting the portion of the front panel 10 that is peeled away from the back panel 20. At the same time, in this position the top of the firearm 110, such as the grip, is accessible to the wearer to remove the firearm 110.

To return the firearm 110 into the stored, concealed position in the holster 1, the above described process is reversed so that the holster 1 is again in the position shown in FIGS. 3A and 3B. That is the firearm 110 is placed within the pouch 34, and the user pushes the holster 1 down so that the front panel 10 and the back panel 20 are again brought together and are concealed within and below the waistline of the user's pants 130.

The above described holster 1 in suitable for both left and right handed users and may be worn on the left side, the right side, or on the backside of the pants 130. The holster 1 may also be modified in size to fit a wide variety of firearms. That is, the size of the panels 10, 20 and pouch 34 may be configured to fit any number of types of firearms 110 that may be carried with a CWL.

Figure 6A:
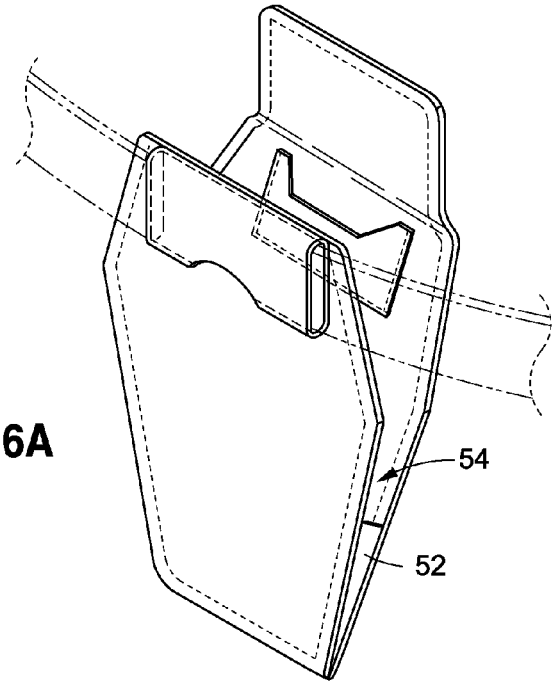
FIG. 6A is a perspective view of an inside waistband holster for a concealed weapon according to one exemplary embodiment.
Figure 6B:
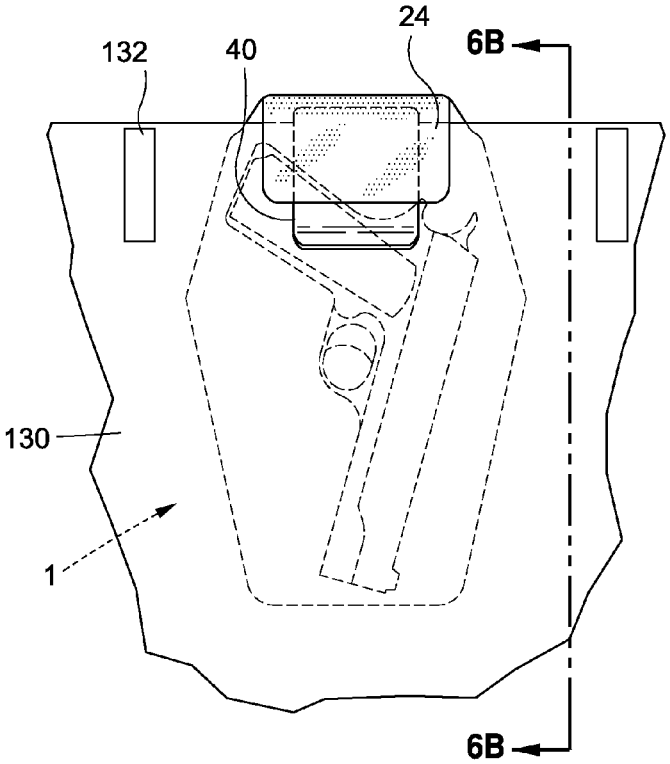
FIG. 6B is a front view of the holster shown in FIG. 6A.
Figure 6C:
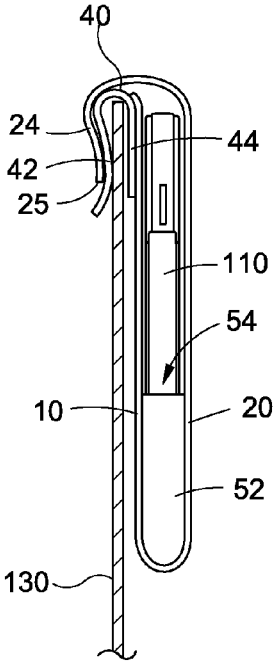
FIG. 6C is a side view of the holster shown in FIG. 6A.

FIG. 6A is a front perspective view of an inside waistband holster for a concealed weapon according to one exemplary embodiment; FIG. 6B is a front view of the holster shown mounted to the waistband with the holster located inside the wearer's pants, and FIG. 6C is a cross-sectional side view of the holster shown in FIG. 6B. In this embodiment, the holster 1 is configured so it may be worn by a user without a belt 120. Here, the holster 1 includes a clip 40 that attached to the top of the user's pants 130 without the need for the belt 120. Thus, as shown in FIG. 6A, there is no belt that is threaded through the belt loops 132 of the pants 130.

The clip 40 may be made of any suitable resilient material including plastics and metals that such that an outer side 42 and an inner side 44 of the clip may be biased together. The clip 40 may also include a torsion spring or other biasing member to bias the outer side 42 and inner side 44 together. In some embodiments, the clip 40 may be covered with a more visibly attractive material such as leather, faux leather, or other material, with the biased member being embedded therein. The clip 40 attached to the front panel 10 such that the holster 1 in this embodiment may operate similar to that described above.

In the embodiment illustrated in FIG. 6A, a pouch 54 is formed on a single panel. Here, the back panel 20 includes the pouch 54 by way of a pliable fabric member 52 stitched to the inner side of the back panel 20. The fabric member 52 may be formed of any suitable material as described above, and may be connected to the panel 20 in any suitable manner. One advantage to this embodiment is that the pouch 54 may extend to cover a substantial portion of the back panel 20 (e.g. may extend higher than shown in the FIGS. 6A-6C) while still allowing the front panel 10 to roll upwards in operation to access the firearm 110.

Other additions and/or modification may be made to offer additional conveniences to a user. As a first example, while a belt loop 14 and clip 40 have been described above, any other waistband connector to attach the front panel 10 to the waistband or other portion of the user's pants 130 may be utilized. As another example, an electronic key fob may be embedded in the belt loop, flap, or other portion of the holster 1 that is programmable to operate a remote device.

The holster 1 described above may not only be utilized to conceal a firearm, but the holster 1 may also be worn in a traditional style outside of the clothing where permitted. That is, the user may position the front and back panels 10, 20 of the holster 1 to be on the outside of the user's pants 130.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A method of carrying a concealed weapon comprising:

obtaining an inside waistband holder comprising:

a front panel formed from a pliable material, the front panel comprising a waistband connector that holds a top side of the front panel at a waistline of a user's pants;

a back panel attached to the front panel along a bottom side of the back panel and the front panel and along lower sides of the back panel and the front panel, the front panel and the back panel defining a pouch in which a firearm may be stored; the back panel further comprising a flap configured to extend over the front panel and to releasably connect to the waistband connector; and a top portion of the front panel that is unattached to the back panel;

connecting the waistband connector to the waistline of the user's pants;

locating said pouch inside of the pants;

inserting one end of the weapon into the pouch;

extending said flap over said weapon located in said pouch and over said top portion of said front panel; and pulling the flap upwards to raise the pouch and peel the top portion of the front panel away from the back panel to raise said weapon into an exposed position.

2. The method in accordance with claim 1 wherein said waistband connector comprises a belt loop and said step of connecting said waistband connector to the waistline of the user's pants comprises connecting said belt loop to a belt which is connected to said waistline of said user's pants.

3. The method in accordance with claim 1 comprising extending said flap over said waistband connector of said front panel.

* * * * *